US005630397A

United States Patent [19]

Shimizu et al.

[11] Patent Number: 5,630,397

[45] Date of Patent: May 20, 1997

[54] CONTROL SYSTEM FOR INTERNAL COMBUSTION ENGINES

[75] Inventors: Daisuke Shimizu; Kenji Nakano; Yuichiro Tanabe; Hiroshi Yatani, all of Wako, Japan

[73] Assignee: Honda Giken Kogyo Kabushiki Kaisha, Tokyo, Japan

[21] Appl. No.: 631,111

[22] Filed: Apr. 12, 1996

[30] Foreign Application Priority Data

Apr. 12, 1995 [JP] Japan ..... 7-111343

[51] Int. Cl.[6] ..... F02M 7/00

[52] U.S. Cl. ..... 123/436

[58] Field of Search ..... 123/436, 419, 123/479, 672, 675, 676; 364/431.07, 431.08; 73/116

[56] References Cited

U.S. PATENT DOCUMENTS

| | | | |
|---|---|---|---|
| 4,930,479 | 6/1990 | Osawa et al. | 123/436 |
| 5,263,364 | 11/1993 | Nakayama et al. | 73/116 |
| 5,263,453 | 11/1993 | Wakahara et al. | 123/436 |
| 5,345,911 | 9/1994 | Kadowaki et al. | 123/436 |
| 5,353,764 | 10/1994 | Tomisawa | 123/435 |
| 5,385,129 | 1/1995 | Eyberg | 123/436 |
| 5,493,901 | 2/1996 | Kuroda et al. | 73/116 |

FOREIGN PATENT DOCUMENTS

| | | | |
|---|---|---|---|
| 58-182516 | 10/1983 | Japan . | |
| 2269017 | 1/1994 | United Kingdom | 123/436 |
| 2277609 | 11/1994 | United Kingdom | 123/436 |

*Primary Examiner*—Raymond A. Nelli

*Attorney, Agent, or Firm*—Nikaido, Marmelstein, Murray & Oram LLP

[57] ABSTRACT

There is provided a control system for an internal combustion engine. An amount of variation in the rotational speed of the engine is detected. A rotational speed variation reference value is calculated based on an averaged value of the detected amount of variation in the rotational speed of the engine. The detected amount of variation in the rotational speed of the engine is compared with the rotational speed variation reference value. The amount of fuel to be supplied to the engine is corrected based on results of the comparison.

14 Claims, 9 Drawing Sheets

LIMIT-CHECKING OF KLSAF
DKLSAF←KOBJ(N) −KLSAF(N−1)
S31
S32
FWOT=1 ?
YES
NO
S33
DKC1←DKC1WOT
S34
DKLSAF>0 ?
YES
NO
S35
KLASAF F/B PROCESSING
S36
NE>NKSLB1 ?
NO
YES
S37
NE>NKSLB2 ?
YES
NO
S39
DKC1←DKC1M1M
S38
DKC1←DKC1M1L
S40
DKC1←DKC1M1H
S41
|DKLSAF| >DKC1 ?
NO
YES
KLSAF(N)← KLSAF(N−1)+DKC1
S42
FSLBFB←0
S43
S44
KLSAF(N) >1.0 ?
YES
NO
S45
KLSAF(N)←1.0
S46
KLSAF(N) <KLSAFL ?
YES
NO
S47
KLSAF(N)←KLSAFL
RETURN

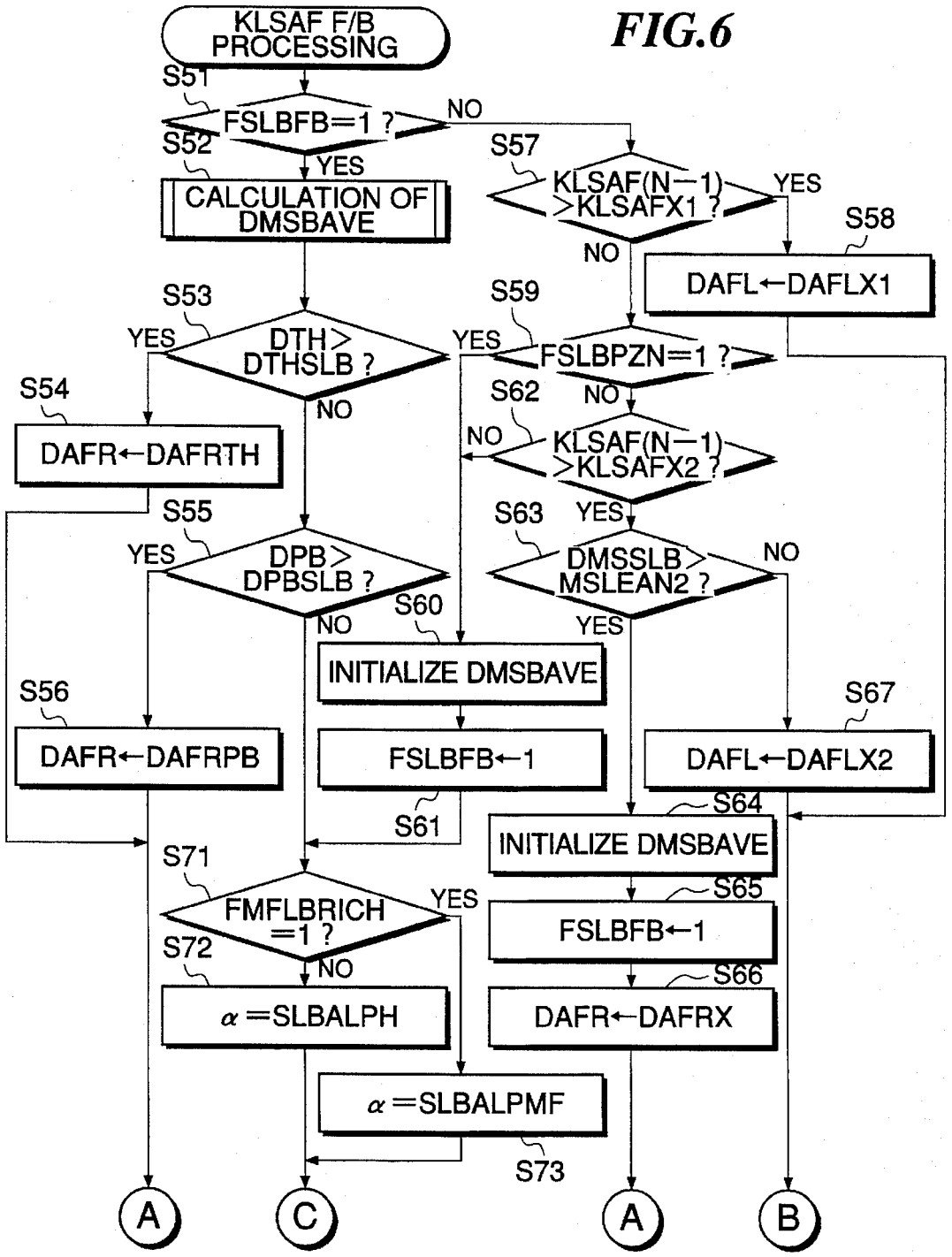
FIG.6
KLSAF F/B PROCESSING
S51
FSLBFB=1 ?
NO
YES
S52
CALCULATION OF DMSBAVE
S57
KLSAF(N−1) >KLSAFX1 ?
YES
NO
S58
DAFL←DAFLX1
S53
DTH> DTHSLB ?
YES
NO
S59
FSLBPZN=1 ?
YES
NO
S54
DAFR←DAFRTH
S62
KLSAF(N−1) >KLSAFX2 ?
NO
YES
S55
DPB> DPBSLB ?
YES
NO
S63
DMSSLB> MSLEAN2 ?
NO
YES
S60
INITIALIZE DMSBAVE
S56
DAFR←DAFRPB
FSLBFB←1
S61
S67
DAFL←DAFLX2
S64
INITIALIZE DMSBAVE
S65
FSLBFB←1
S66
DAFR←DAFRX
S71
FMFLBRICH =1 ?
YES
NO
S72
α =SLBALPH
α =SLBALPMF
S73
A
C
A
B

CONTROL SYSTEM FOR INTERNAL COMBUSTION ENGINES

BACKGROUND OF THE INVENTION

1. Field of the Invention

This invention relates to a control system for internal combustion engines, which detects the combustion state of the engine and controls the amount of fuel supplied to the engine based on the detected combustion state.

2. Prior Art

Conventionally, it is widely known to control the air-fuel ratio of a mixture supplied to an internal combustion engine to a leaner value than a stoichiometric air-fuel ratio in order to curtail the fuel consumption, as well as to recirculate part of exhaust gases from the exhaust system of an internal combustion engine to the intake system of the same in order to improve exhaust emission characteristics of the engine. However, if the leaning of the air-fuel ratio and/or the exhaust gas recirculation is carried out to an excessive extent, the engine will have unstable combustion and hence have degraded driveability. To avoid this inconvenience, it has been conventionally proposed by Japanese Laid-Open Patent Publication (Kokai) No. 58-182516, to detect the combustion state of an internal combustion engine by the use of a vibration sensor, and enrich the air-fuel ratio of a mixture supplied to the engine when the detected vibration value from the vibration sensor exceeds a predetermined reference value.

According to the proposed method, however, the predetermined reference value employed to determine whether enriching of the air-fuel ratio is to be carried out is a fixed value. Therefore, if the predetermined reference value is set to a too large value, the combustion state of the engine can become unstable, causing degraded driveability, even when the detected vibration value is below the predetermined reference value, depending on manufacturing variations of component parts of the engine between production lots and/or the degree of deterioration or aging of component parts of the engine. To avoid such an inconvenience, it is required to set the predetermined reference value to a value which is considerably smaller than a limit value at or below which leaning of the air-fuel ratio is permitted. Thus, there is still a demand for a technique of controlling the fuel supply amount which can further improve the fuel consumption characteristic or fuel economy of an internal combustion engine, while maintaining good driveability of the engine.

SUMMARY OF THE INVENTION

It is an object of the invention to provide a control system for an internal combustion engine, which is capable of improving the fuel economy of the engine while maintaining good driveability of the engine, irrespective of manufacturing variations of component parts of the engine between production lots and/or the degree of deterioration or aging of component parts of the engine.

To attain the above object, according to a first aspect of the invention, there is provided a control system for an internal combustion engine, comprising:

- fuel supply amount-calculating means for calculating an amount of fuel to be supplied to the engine;
- rotational speed variation-detecting means for detecting an amount of variation in rotational speed of the engine;
- averaging means for averaging the amount of variation in the rotational speed of the engine detected by the rotational speed variation-detecting means;

- rotational speed variation reference value-calculating means for calculating a rotational speed variation reference value based on an average value of the amount of variation from the averaging means;
- comparison means for comparing the detected amount of variation in the rotational speed of the engine with the rotational speed variation reference value; and
- correction means for correcting the amount of fuel to be supplied to the engine calculated by the fuel supply amount-calculating means, based on results of the comparison by the comparison means.

Preferably, the rotational speed variation reference value is set to such a value that when the detected amount of variation in the rotational speed of the engine exceeds the rotational speed variation reference value, a combustion state of the engine can become unstable.

More preferably, the correction means corrects the amount of fuel to be supplied to the engine in such a direction that the combustion state of the engine becomes stabilized, when the detected amount of variation in the rotational speed of the engine exceeds the rotational speed variation reference value.

Preferably, the rotational speed variation reference value comprises a first rotational speed variation reference value and a second rotational speed variation reference value, the first rotational speed variation reference value being set to such a value that when the detected amount of variation in the rotational speed of the engine exceeds the first rotational speed variation reference value, a combustion state of the engine can become unstable, the second rotational speed variation reference value being set to a value smaller than the first rotational speed variation reference value.

More preferably, the correction means corrects the amount of fuel to be supplied to the engine in such a direction that the combustion state of the engine becomes stabilized, when the detected amount of variation in the rotational speed of the engine exceeds the first rotational speed variation reference value, while the correction means corrects the amount of fuel to be supplied to the engine in such a direction that the engine has improved fuel economy, when the detected amount of variation in the rotational speed of the engine is below the second rotational speed variation reference value.

According to a second aspect of the invention, there is provided a control system for an internal combustion engine installed on an automotive vehicle, comprising:

- operating condition-detecting means for detecting operating conditions of at least one of the engine and the automotive vehicle;
- fuel supply amount-calculating means for calculating an amount of fuel to be supplied to the engine;
- combustion state-detecting means for detecting a parameter indicative of a combustion state of the engine;
- first combustion state reference value-calculating means for calculating a first combustion state reference value based on the parameter indicative of the combustion state of the engine detected by the combustion state-detecting means;
- second combustion state reference value-calculating means for calculating a second combustion state reference value depending on the operating conditions of the at least one of the engine and the automotive vehicle detected by the operating condition-detecting means;
- comparison means for comparing the detected parameter indicative of the combustion state of the engine with the first combustion state reference value and the second combustion state reference value; and correction means for correcting the amount of fuel to be supplied to the engine calculated by the fuel supply amount-calculating means, based on results of the comparison by the comparison means.

Preferably, the operating conditions of the at least one of the engine and the automotive vehicle include at least one of rotational speed of the engine, load on the engine, and a gear ratio of the automotive vehicle.

Preferably, the parameter indicative of the combustion state of the engine is an amount of variation in rotational speed of the engine.

Preferably, the first combustion state reference value is set based on an average value of the parameter indicative of the combustion state of the engine.

Preferably, the first combustion state reference value comprises a combustion-unstable side reference value set to such a value that when a degree of unstability of the combustion state of the engine indicated by the detected parameter exceeds the combustion-unstable side reference value, the combustion state of the engine can become unstable, and a combustion-stable side reference value set to a value higher in stability than the combustion-unstable side reference value.

More preferably, the correction means corrects the amount of fuel to be supplied to the engine in such a direction that the combustion state of the engine becomes stabilized, when the degree of unstability of the combustion state of the engine indicated by the detected parameter exceeds the combustion-unstable side reference value of the first combustion state reference value, while the correction means corrects the amount of fuel to be supplied to the engine in such a direction that the engine has improved fuel economy, when the degree of unstability of the combustion state of the engine indicated by the detected parameter is below the combustion-stable side reference value of the first combustion state reference value.

More preferably, the second combustion state reference value comprises a combustion-unstable side reference value set to such a value that when a degree of unstability of the combustion state of the engine indicated by the detected parameter exceeds the combustion-unstable side reference value of the second combustion state reference value, the combustion state of the engine can become unstable, and a combustion-stable side reference value set to value higher in stability than the combustion-unstable side reference value of the second combustion state reference value.

Further preferably, the second combustion state reference value comprises a combustion-unstable side reference value set to such a value that when a degree of unstability of the combustion state of the engine indicated by the detected parameter exceeds the combustion-unstable side reference value of the second combustion state reference value, the combustion state of the engine can become unstable, and a combustion-stable side reference value set to a value higher in stability than the combustion-unstable side reference value of the second combustion state reference value, and when the degree of unstability of the combustion state of the engine indicated by the detected parameter exceeds the combustion-unstable side reference value of the second combustion state reference value, the correction means corrects the amount of fuel to be supplied to the engine by the use of a first correction amount in such a direction that the combustion state of the engine becomes stabilized when the degree of unstability of the combustion state of the engine indicated by the detected parameter exceeds the combustion-unstable side reference value of the first combustion state reference value, while the correction means corrects the amount of fuel to be supplied to the engine by the use of a second correction amount smaller than the first correction amount in such a direction that the combustion state of the engine becomes stabilized when the degree of unstability of the combustion state of the engine indicated by the detected parameter is below the combustion-unstable side reference value of the first combustion state reference value.

Further preferably, the second combustion state reference value comprises a combustion-unstable side reference value set to such a value that when a degree of unstability of the combustion state of the engine indicated by the detected parameter exceeds the combustion-unstable side reference value of the second combustion state reference value, the combustion state of the engine can become unstable, and a combustion-stable side reference value set to a value higher in stability than the combustion-unstable side reference value of the second combustion state reference value, and when the degree of unstability of the combustion state of the engine indicated by the detected parameter is below the combustion-stable side reference value of the second combustion state reference value, the correction means corrects the amount of fuel to be supplied to the engine by the use of a first correction amount in such a direction that the engine has improved fuel economy when the degree of unstability of the combustion state of the engine indicated by the detected parameter exceeds the combustion-stable side reference value of the first combustion state reference value, while the correction means corrects the amount of fuel to be supplied to the engine by the use of a second correction amount larger than the first correction amount in such a direction that the engine has improved fuel economy when the degree of unstability of the combustion state of the engine indicated by the detected parameter is below the combustion-stable side reference value of the first combustion state reference value.

The above and other objects, features, and advantages of the invention will become more apparent from the following detailed description taken in conjunction with the accompanying drawings.

BRIEF DESCRIPTION OF THE DRAWINGS

FIGS. 2A and 2B are flowcharts showing routines for detecting a rotational speed variation amount DMSSLB of the engine, in which:

FIG. 2A is a flowchart showing a routine for a CRK processing; and

FIG. 2B is a flowchart showing a routine for a #STG processing;

FIG. 6 is a flowchart showing a routine for executing feedback control of the lean-burn correction coefficient KLSAF;

FIGS. 8A and 8B show tables for determining second threshold values MSLEAN1, MSLEAN 2, in which:

FIG. 8A shows a table for determining the second threshold values according to the engine rotational speed NE; and FIG. 8B shows a table for determining the second threshold values according to intake pipe absolute pressure;

FIGS. 9A and 9B are diagrams which are useful in explaining the relationship between the rotational speed variation amount DMSSLB and the lean-burn correction coefficient KLSAF, in which:

FIG. 9A shows changes in the lean-burn correction coefficient KLSAF; and

FIG. 9B shows changes in the rotational speed variation amount DMSSLB.

DETAILED DESCRIPTION

The invention will now be described in detail with reference to the drawings showing an embodiment thereof.

Figure 1:
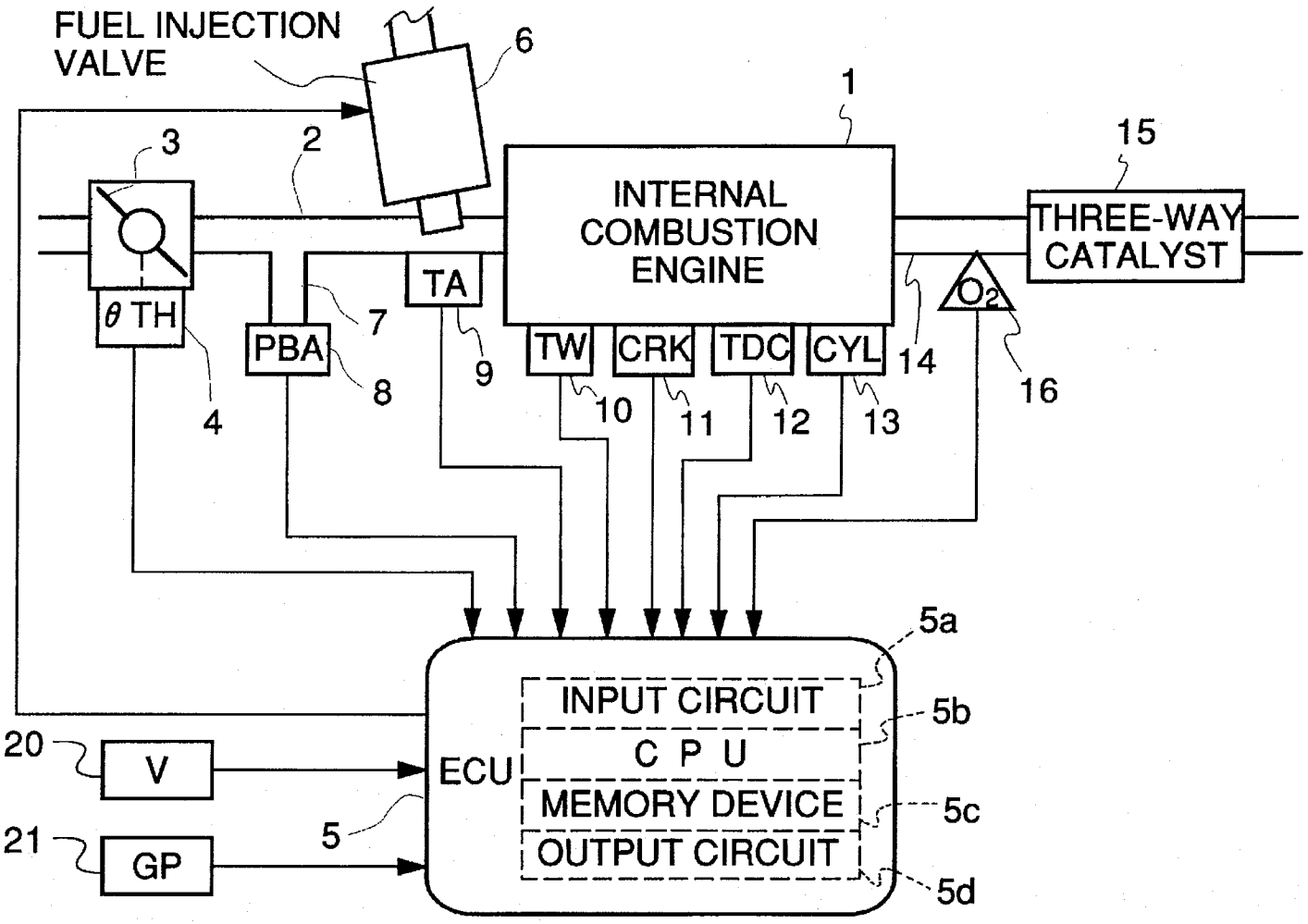
FIG. 1 is a block diagram showing the whole arrangement of an internal combustion engine incorporating a control system according to an embodiment of the invention.

Referring first to FIG. 1, there is shown the whole arrangement of an internal combustion engine(hereinafter referred to as "the engine") 1 incorporating a control system therefor according to an embodiment of the invention. Connected to the cylinder block of the engine 1 is an intake pipe 2 in which is arranged a throttle valve 3. A throttle valve opening (θTH) sensor 4 is connected to the throttle valve 3 for generating an electric signal indicative of the sensed throttle valve opening θTH and supplying the same to an electronic control unit (hereinafter referred to as "the ECU") 5.

Fuel injection valves 6, only one of which is shown, are inserted into the interior of the intake pipe 2 at locations intermediate between the cylinder block of the engine 1 and the throttle valve 3 and slightly upstream of respective corresponding intake valves, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is provided in communication with the interior of the intake pipe 2 at a location immediately downstream of the throttle valve 3 for supplying an electric signal indicative of the sensed absolute pressure PBA within the intake pipe 2 to the ECU 5. An intake air temperature (TA) sensor 9 is inserted into the intake pipe 2 at a location downstream of the intake pipe absolute pressure sensor 8 for supplying an electric signal indicative of the sensed intake air temperature to the ECU 5.

An engine coolant temperature (TW) sensor 10, which may be formed of a thermistor or the like, is mounted in the cylinder block of the engine 1, for supplying an electric signal indicative of the sensed engine coolant temperature TW to the ECU 5.

Arranged in facing relation to a camshaft or a crankshaft of the engine 1, neither of which is shown, are a cylinder-discriminating sensor (hereinafter referred to as "the CYL sensor") 13 which generates a pulse (hereinafter referred to as "the CYL signal pulse") at a predetermined crank angle position of a particular cylinder of the engine a predetermined angle before a TDC position corresponding to the start of the intake stroke of the cylinder, a TDC sensor 12 which generates a pulse (hereinafter referred to as "the TDC signal pulse") at a predetermined crank angle position of each cylinder a predetermined angle before the TDC position (whenever the crankshaft rotates through 180 degrees in the case of a four-cylinder engine), and a crank angle sensor (hereinafter referred to as "the CRK sensor") 11 which generates a pulse (hereinafter referred to as "the CRK signal pulse") at each of predetermined crank angle positions whenever the crank shaft rotates through a predetermined angle (e.g. 30 degrees) smaller than the rotational angle interval of generation of the TDC signal pulse. The CYL signal pulse, the TDC signal pulse, and the CRK signal pulse are supplied to the ECU 5.

A three-way catalyst 15 is arranged within an exhaust pipe 14 connected to the cylinder block of the engine 1, for purifying noxious components such as HC, CO, and NOx. An O2 sensor 16 as an oxygen concentration sensor is mounted in the exhaust pipe 14 at a location upstream of the three-way catalyst 15 for sensing the concentration of oxygen present in exhaust gases emitted from the engine 1 and supplying an electric signal indicative of the sensed oxygen concentration value to the ECU 5.

Further connected to the ECU 5 are a vehicle speed (V) sensor 20 for detecting the traveling speed V of an automotive vehicle on which the engine is installed, a gear ratio sensor 21 for detecting a gear ratio (shift position) of a transmission of the vehicle, etc., for supplying respective signals indicative of the detected parameters to the ECU 5. Alternatively, the gear ratio may be detected based on the vehicle speed V and the engine rotational speed NE.

The ECU 5 is comprised of an input circuit 5*a* having the functions of shaping the waveforms of input signals from various sensors, shifting the voltage levels of sensor output signals to a predetermined level, converting analog signals from analog-output sensors to digital signals, and so forth, a central processing unit (hereinafter referred to as "the CPU") 5*b*, a memory device 5*c* storing various operational programs which are executed by the CPU 5*b*, and for storing results of calculations therefrom, etc., and an output circuit 5*d* which outputs driving signals to the fuel injection valves 6, etc.

The CPU 5*b* operates in response to the above-mentioned signals from the sensors to determine various operating conditions in which the engine 1 is operating, such as an air-fuel ratio feedback control region in which the air-fuel ratio of a mixture supplied to the engine 1 is controlled in response to the detected oxygen concentration in the exhaust gases, and open-loop control regions other than the air-fuel ratio feedback control region, and calculates, based upon the determined operating conditions, the valve opening period or fuel injection period TOUT over which the fuel injection valves 6 are to be opened, by the use of the following equation (1), in synchronism with inputting of TDC signal pulses to the ECU 5:

$$TOUT=Ti\times KLSLAF\times KO2\times K1+K2 \quad (1)$$

where Ti represents a basic value of the fuel injection period TOUT, which is determined in accordance with the engine rotational speed NE and the intake pipe absolute pressure PBA. A TI map for use in determining the Ti value is stored in the memory device 5*c*.

KLSAF represents a lean-burn correction coefficient which is set to a value smaller than "1.0" when the engine and the vehicle are in respective predetermined operating conditions. A manner of determining the lean-burn correction coefficient KLSAF will be described in detail hereinafter with reference to FIGS. 2A to 9B.

KO2 represents an air-fuel ratio feedback control correction coefficient whose value is determined in response to a value of the oxygen concentration in the exhaust gases detected by the O2 sensor 16 such that the detected air-fuel ratio (oxygen concentration) becomes equal to a stoichiometric value during air-fuel ratio feedback control, while it is set to respective predetermined appropriate or learned values while the engine is in the open-loop control regions.

K1 and K2 represent other correction coefficients and correction variables, respectively, which are calculated based on various engine operating parameter signals to such values as to optimize characteristics of the engine such as fuel consumption and driveability depending on operating conditions of the engine.

Figure 2A:
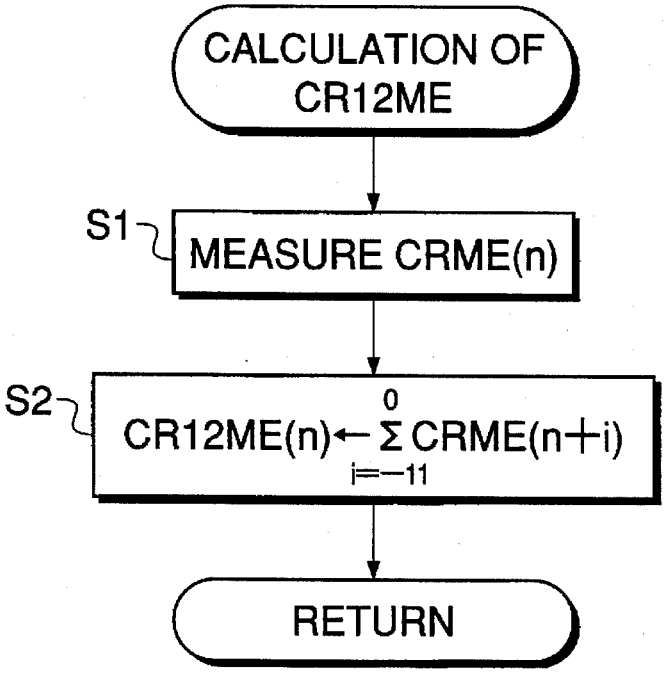
Figure 2B:
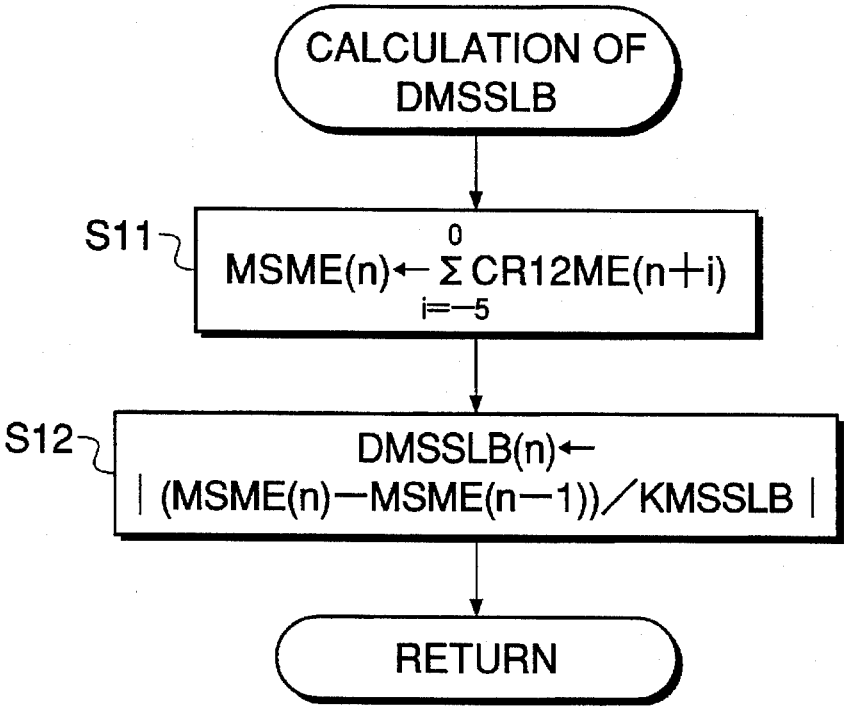

FIGS. 2A and 2B show routines for calculating a rotational speed variation amount DMSSLB for use in calculating the lean-burn correction coefficient KLASF, which is executed by the CPU 5*b*.

Figure 3:
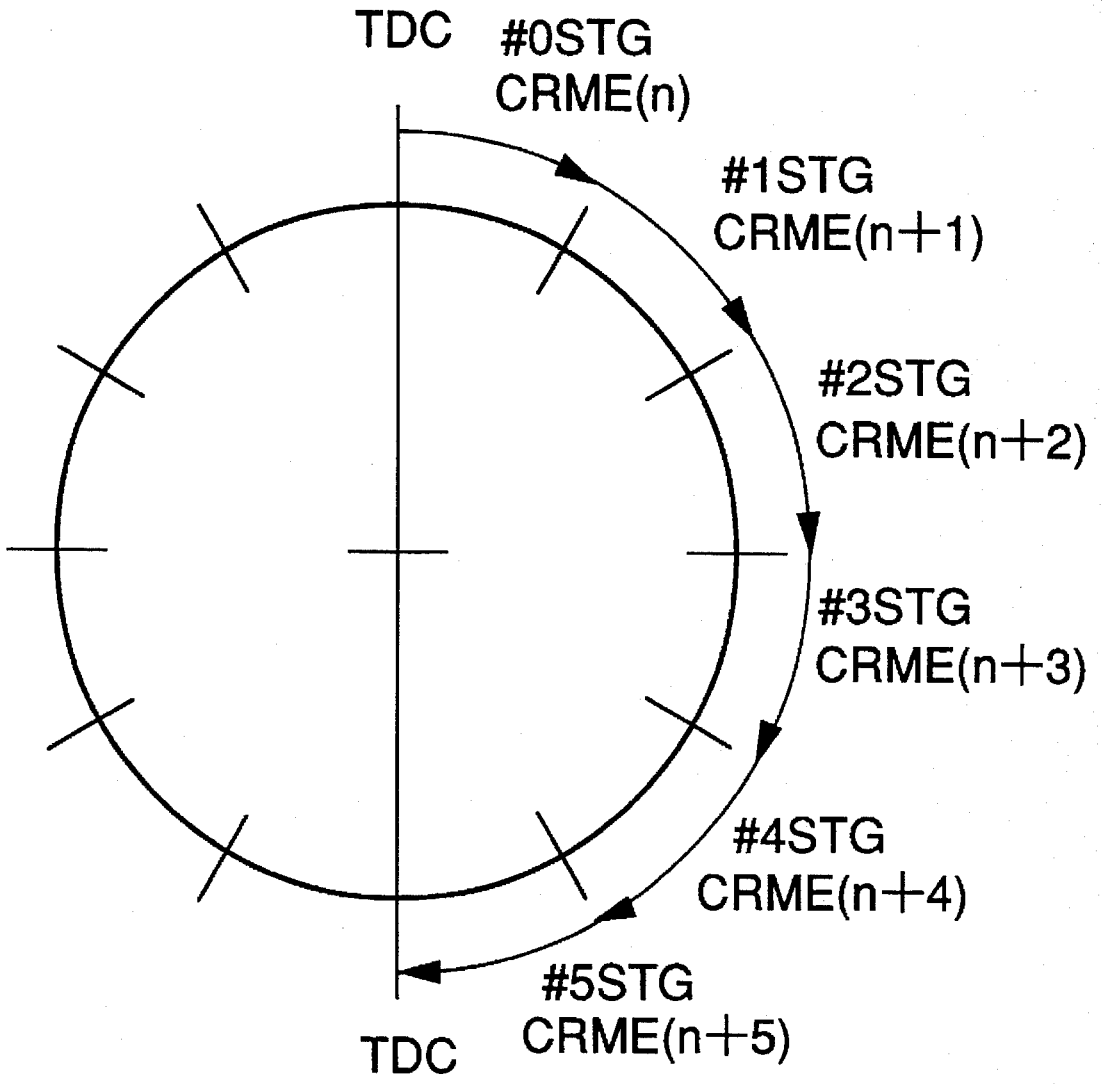
FIG. 3 is a diagram which is useful in explaining the relationship between a manner of measuring a parameter indicative of the rotational speed of the engine and the rotational angle of a crankshaft of the engine.

FIG. 2A shows a routine for a CRK processing which is executed in synchronism with generation of each CRK signal pulse. First, at a step S1, time intervals CRMe(n) of occurrence of CRK signal pulses (values of a parameter proportional to the reciprocal of the engine rotational speed) are calculated. More specifically, time interval values of CRMe(n), CRMe(n+1), CRMe(n+2) . . . are successively measured whenever the crankshaft rotates through 30 degrees, as shown in FIG. 3.

In this connection, the repetition period of rotation of the crankshaft through 180 degrees is divided into #0 to #5 stages (#0STG to #5STG) each corresponding to each time period of rotation of the crankshaft through 30 degrees.

At a step S2, an average value of 12 CRMe values from a value CRMe(n−11) measured eleven loops before the present loop to a value CRMe(n) in the present loop is calculated by the use of the following equation (2):

$$CR12ME(n) = 1/12 \times \sum_{i=-11}^{0} CRME(n+i) \quad (2)$$

In the present embodiment, since CRK signal pulses are each generated whenever the crankshaft rotates through 30 degrees, the first average value CR12ME(n) is obtained over one rotation of the crankshaft. The first average value CRME(n) obtained by such averaging every period of one rotation of the crankshaft is free of the influence of primary vibration components in engine rotation over a period of one rotation of the crankshaft, i.e. noise components due to dimensional errors (such as manufacturing tolerances and mounting tolerances) of a pulser or a pickup forming the crank angle sensor 11.

The engine rotational speed NE is also calculated based on the CRME(n) value.

FIG. 2B shows a subroutine which is executed at a #3stage #3STG (see FIG. 3) in synchronism with generation of each TDC signal pulse. First, at a step S11, a second average value MSME(n) is calculated by averaging six CRME values from a value CRME(n−5) obtained five loops before the present loop to a value CRME(n) in the present loop, by the use of the following equation (3):

$$MSME(n) = 1/6 \times \sum_{i=-5}^{0} CRME(n+i) \quad (3)$$

In the present embodiment, the engine 1 is a 4-cylinder /4-cycle engine, wherein spark ignition is carried out at any one of the cylinders (#1 cylinder to #4 cylinder) whenever the crankshaft rotates through 180 degrees. Therefore, the second average value M(n) is obtained from the first average value CR12ME(n) over one firing period. The second average value M(n) obtained by such averaging per ignition cycle is free of secondary vibration components representing a variation in torque of the engine due to combustion, i.e. vibration components in engine rotation over a period of a half rotation of the crankshaft.

Then, the rotational speed variation amount DMSSLB(n) is calculated by the use of the following equation (4):

$$DMSSLB(n)=|(MSME(n)-MSME(n-1))/KMSSLB| \quad (4)$$

where KMSSLB represents a coefficient which is set to a value inversely proportional to the engine rotational speed NE so as to prevent the calculated rotational speed variation amount DMSSLB from being varied with the engine rotational speed NE, whereby the accuracy of lean-burn control is maintained constant irrespective of the engine rotational speed NE.

The rotational speed variation amount DMSSLB thus calculated tends to increase as the combustion state of the engine becomes worse, and hence can be used as a parameter indicative of the combustion state of the engine. In general, as the air-fuel ratio is set to leaner values, the combustion state of the engine progressively becomes unstable. FIG. 9B shows an irregular combustion state of the engine which takes place when the air-fuel ratio is controlled to such a lean limit or a close value thereto. This irregular combustion state is characterized by spikes of the DMSSLB value each occurring every several seconds. If the air-fuel ratio is learned beyond this limit, the engine enters an unstable combustion state in which surging of the engine rotational speed can be sensed by the driver through vibrations transmitted to his body from the engine. Therefore, it is preferable that the air-fuel ratio is controlled to the above lean limit at most as will cause an irregular combustion state as shown in FIG. 9B or a value slightly richer than the limit so as to maintain a stable combustion state of the engine.

Figure 4:
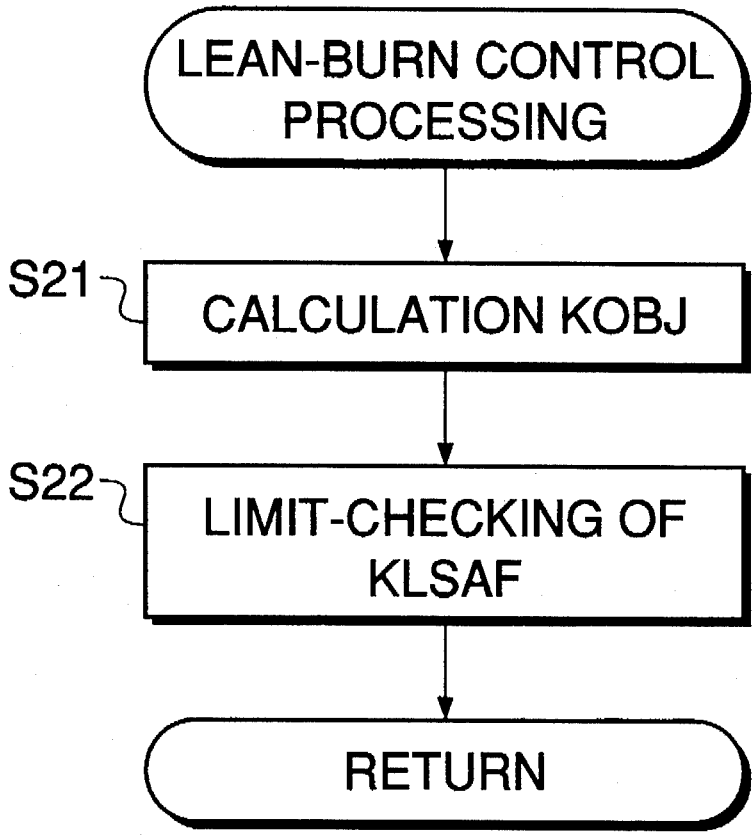
FIG. 4 is a flowchart showing a routine for a lean-burn control processing.

FIG. 4 shows a routine for a lean-burn control processing, which is executed to carry out the above-mentioned preferable air-fuel ratio control in synchronism with generation of each TDC signal pulse.

First, at a step S21, a desired air-fuel ratio (desired equivalent ratio) KOBJ is calculated by a routine, not shown. The desired air-fuel ratio KOBJ is calculated based on the engine coolant temperature TW, the gear ratio, the vehicle speed V, the throttle valve opening θTH, the engine rotational speed NE, the intake pipe absolute pressure PBA, etc., to a value smaller than 1.0 when the engine is in such an operating condition as will permit execution of lean-burn control, e.g. when the throttle valve opening θTH is smaller than a predetermined value, the vehicle speed V is lower than a predetermined value, and at the same time the gear ratio is larger than a predetermined value, and to 1.0 when the engine is operating in a condition other than the above condition.

Figure 5:
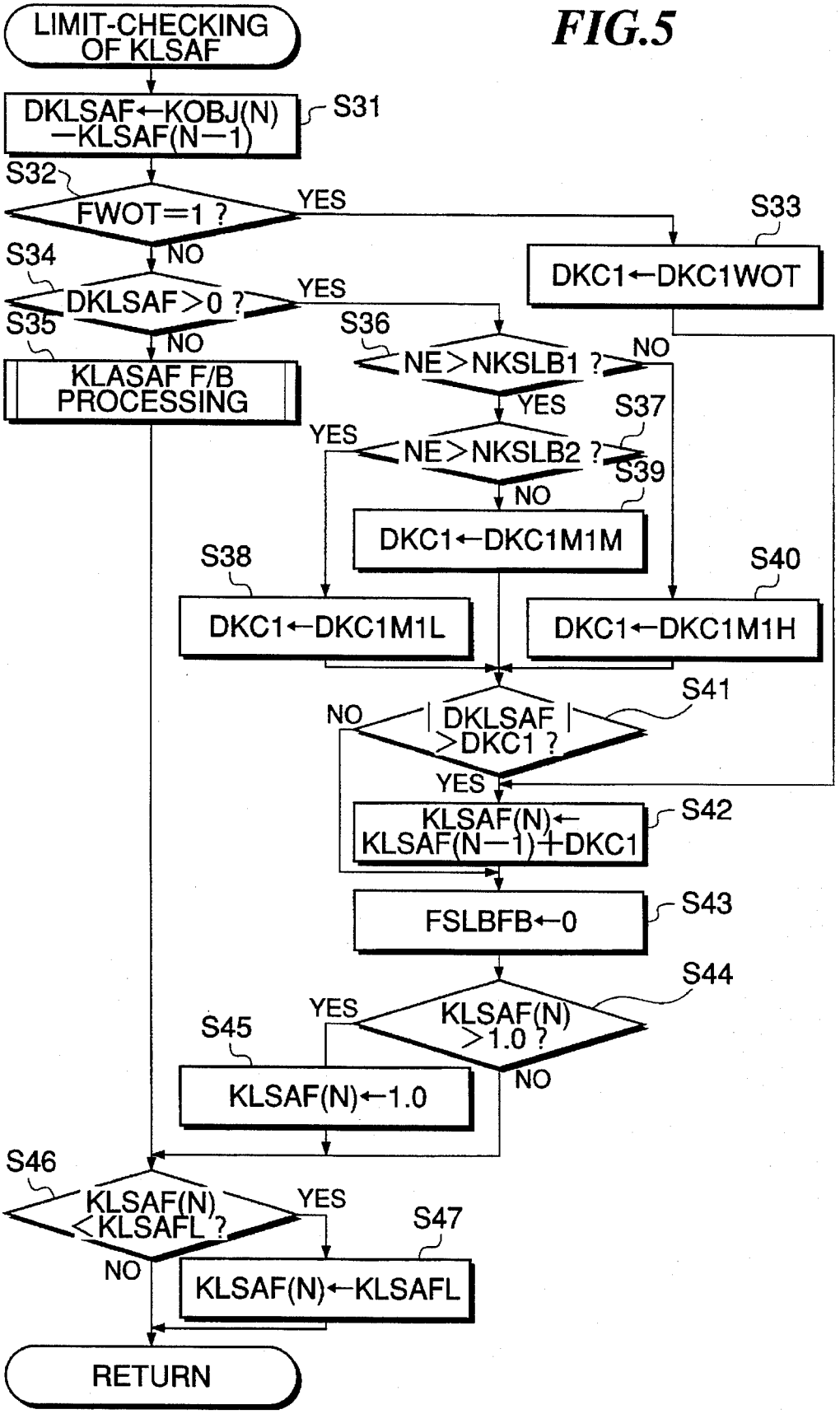
FIG. 5 is a flowchart showing a routine for limit-checking of a lean-burn correction coefficient KLSAF.
Figure 7:
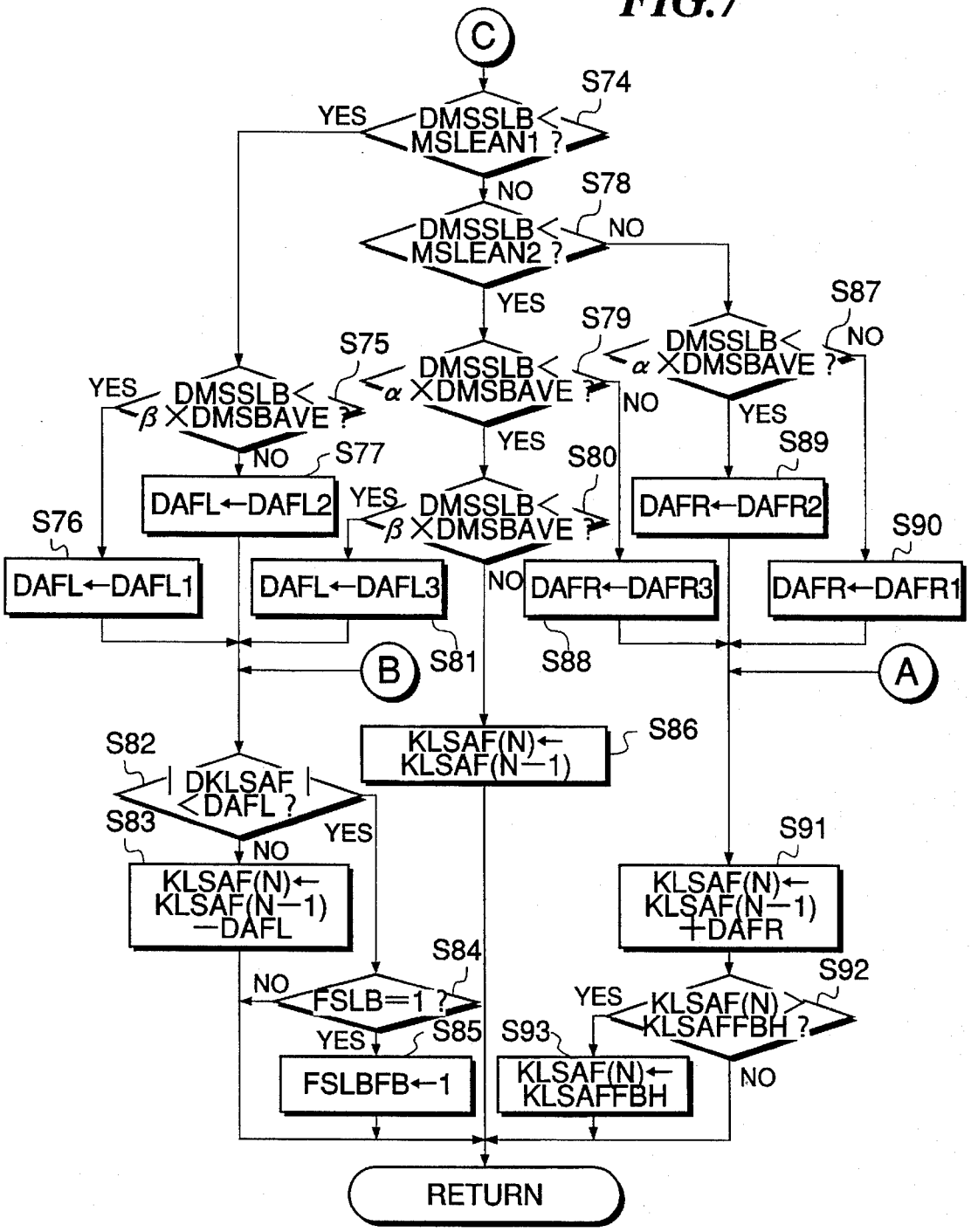
FIG. 7 is a continued part of the FIG. 6 flowchart.

The desired air-fuel ratio KOBJ is set to the present value KLSAF(N) when the latter is updated by routines shown in FIGS. 5 to 7.

At the following step S22, limit-checking of the lean-burn correction coefficient KLSAF is carried out by executing a subroutine shown in FIG. 5.

Referring to FIG. 5, at a step S31, an amount of change DKLSAF is calculated as the difference between the present desired air-fuel ratio value KOBJ(N) and the immediately preceding lean-burn correction coefficient value KLSAF(N−1) by the use of the following equation (5):

$$DKLSAF=KOBJ(N)-KLSAF(N-1) \quad (5)$$

The DKLSAF value is also used to determine whether the air-fuel ratio is being corrected in an enriching direction or in a leaning direction in the present loop.

At the following step S32, it is determined whether or not a WOT flag FWOT, which, when set to "1", indicates that the engine 1 is in a WOT (wide open throttle) region, assumes "1". If FWOT=1 holds, an addend term DKC1 is set to a predetermined value DK1WOT suitable for the WOT region at a step S33, and then the present lean burn correction coefficient value KLSAF(N) is calculated at a step S42 by the use of the following equation (6):

$$KLSAF(N)=KLSAF(N-1)+DKC1 \quad (6)$$

Then, a lean feedback control flag FSLBFB, which, when set to "1", indicates that the lean-burn correction coefficient KLSAF is to be set according to the rotational speed variation amount DMSSLB (i.e. the feedback control of the lean-burn correction coefficient KLSAF (lean-burn feedback control) is being carried out), is set to "0" at a step S43, and it is determined at a step S44 whether or not the present value KLSAF(N) is larger than 1.0. If KLSAF(N)≦1.0 holds, the program jumps to a step S46, whereas if KLSAF (N)>1.0 holds, the present value KLSAF(N) is set to 1.0 at a step S45 and then the program proceeds to the step S46.

At the step S46, it is determined whether or not the present value KLSAF(N) is smaller than a predetermined lower limit value KLSAFL. If KLSAF(N)≧KLSAFL holds, the program is immediately terminated, whereas if KLSAF<KLSAFL holds, the present value KLSAF(N) is set to the predetermined lower limit value KLSAFL at a step S47, followed by terminating the program.

If FWOT=0 holds at the step S32, it is determined at a step S34 whether or not the amount of change DKLSAF calculated at the step S31 assumes a positive value. If the answer to this question is affirmative (YES), which means that the KLSAF value, which has been just set to the KOBJ value, has increased, it is determined at a step S36 whether or not the engine rotational speed NE is higher than a first predetermined NE value NKSLB1. If NE≦NKSLB1 holds, the addend term DKC1 is set to a predetermined value DKC1M1H suitable for a low NE region at a step S40, followed by the program proceeding to a step S41.

If NE>NKSLB1 holds at the step S36, it is further determined at a step S37 whether or not the engine rotational speed NE is higher than a second predetermined NE value NKSLB2 which is higher than the first predetermined NE value NKSLB1. If NE≦NKSLB2 holds, the addend term DKC1 is set to a predetermined value DKC1M1M suitable for a medium NE region at a step S39, whereas if NE>NKSLB2 holds, the addend term DKC1 is set to a predetermined value DKC1M1L suitable for a high NE region, and then the program proceeds to the step S41. These predetermined values are in the relationship of DKC1M1H>DKC1M1M>DKC1M1L.

At the step S41, it is determined whether or not the absolute value of the amount of change DKLSAF calculated at the step S31 is larger than the addend term DKC1. If |DKLSAF|≦DKC1 holds, the program jumps to a step S43, whereas if |DKLSAF|>DKC1 holds, the step S42 is executed, and then the program proceeds to the step S43.

As described above, if FWOT=1 holds, i.e. if the engine is in the WOT region, or if DKLSAF>0 holds, i.e. if the KLSAF value, just set to the KOBJ value, has increased, the lean-burn feedback control is inhibited, i.e. setting of the lean-burn correction coefficient KLSAF according to the rotational speed variation amount DMSSLB is not carried out.

If DKLSAF≦0 holds at the step S34, i.e. if the KLSAF value has decreased or remains unchanged, a KLSAF feedback control processing is carried out by executing a routine shown in FIGS. 6 and 7, and then the program proceeds to the step S46.

Next, the KLSAF feedback control processing will be described with reference to FIG. 6 and 7.

Referring to FIG. 6, first, at a step S51, it is determined whether or not the lean feedback control flag FSLBFB assumes "1". If FSLBFB=1 holds, an average value DMSBAVE of the amount of change DMSSLB is calculated by the use of the following equation (7):

$$DMSBAVE=DMSCRF\times DMSSLB(N)/A+(A-DMSCRF)\times DMSBAVE(N-1)/A \quad (7)$$

where A represents a predetermined value set e.g. to 10000HEX, DMSCRF an averaging coefficient set to a value between 1 to A, and DMSBAVE(N−1) the immediately preceding value of the average value DMSBAVE.

At the following step S53, it is determined whether or not an amount of change DTH (=θTH(N)−θTH(N−1)) in the throttle valve opening θTH is larger than a predetermined value DTHSLB. If DTH>DTHSLB holds, which means that a rate of change in the throttle valve opening θTH is large (the accelerator pedal is largely stepped on), an enriching correction coefficient DAFR is set to a predetermined value DAFRTH suitable for θTH-increasing conditions at a step S54, followed by the program proceeding to a step S91 in FIG. 7.

At the step S91, the enriching correction coefficient DAFR is added to the immediately preceding value KLSAF (N−1) of the lean-burn correction coefficient to calculate the present value KLSAF(N) by the use of the following equation (8) to substitute for the KLSAF(N) set to the KOBJ(N) value:

$$KLSAF(N)=KLSAF(N-1)+DAFR \quad (8)$$

Then, it is determined at a step S92 whether or not the present value KLSAF(N) thus obtained is larger than a predetermined upper limit value KLSAFFBH. If KLSAF(N) ≦KLSAFFBH holds, the program is immediately terminated, whereas if KLSAF(N)>KLSAFFBH holds, the present value KLSAF(N) is set to the predetermined upper limit value KLSAFFBH at a step S93, followed by terminating the program.

Referring again to FIG. 6, if DTH≦DTHSLB holds at the step S53, it is determined at a step S55 whether or not an amount of change DPB (=(PBA(N)−PBA(N−1)) in the intake pipe absolute pressure PBA is larger than a predetermined value DPBSLB. If DPB>DPBSLB holds, the enriching correction coefficient DAFR is set to a predetermined value DAFRPB suitable for load-increasing conditions of the engine at a step S56, followed by the program proceeding to the step S91 (FIG. 7).

If DPB≦DPBSLB holds at the step S55, it is determined at a step S71 whether or not an enriching request flag FMFLBRICH, which, when set to "1", indicates that it is required to enrich the air-fuel ratio due to detection of a misfire, assumes "1". If FMFLBRICH=0 holds, a coefficient α for determining a first upper threshold value (α×DMSBAVE) (α>1.0, see FIG. 9B) of the rotational speed variation amount DMSSLB is set to a predetermined value SLBALPH suitable for normal operating conditions of the engine at a step S72, whereas if FMFLBRICH=1 holds, the coefficient α is set to a predetermined value SLBALPMF (<SLBALPH) suitable for a misfire-detecting condition at a step S73, followed by the program proceeding to a step S74 in FIG. 7.

At the step S74, it is determined whether or not the rotational speed variation amount DMSSLB is smaller than a second lower threshold value MSLEAN1 (see FIG. 9B). If DMSSLB<MSLEAN1 holds, it is further determined at a step S75 whether or not the rotational speed variation amount DMSSLB is smaller than a first lower threshold value (β×DMSBAVE) (β<1.0).

If DMSSLB<(β×DMSBAVE) holds at the step S75, a leaning correction term DAFL is set to a first predetermined value DAFL1 at a step S76, whereas if DMSSLB≧(β×DMSBAVE) holds, the leaning correction term DAFL is set to a second predetermined value DAFL2 which is smaller than the first predetermined value DAFL1 at a step S77, and then the program proceeding to a step S82.

At the step S82, it is determined whether or not the absolute value of the amount of change DKLSAF in the KLSAF value calculated at the step S31 in FIG. 5 is smaller than the leaning correction term DAFL. If |DKLSAF|≧DAFL holds, the leaning correction term DAFL is subtracted from the immediately preceding value KLSAF (N−1) by the use of the following equation (9) to calculate the present value KLSAF(N), followed by terminating the present program:

$$KLSAF(N)=KLSAF(N-1)-DAFL \quad (9)$$

Thus, if |DKLSAF|≧DAFL, which means that the present value KLSAF(N) has decreased from the immediately preceding value KLSAF(N−1) by an amount larger than the leaning correction term DAFL, the present value KLSAF(N) is corrected such that the amount of decrease in the KLSAF (N) value becomes equal to the DAFL value set according to the rotational speed variation amount DMSSLB, thereby preventing excessive leaning of the air-fuel ratio.

If |DKLSAF|<DAFL holds at the step S82, the program proceeds to a step S84, wherein it is determined whether or not a lean flag FSLB, which, when set to "1", indicates that KLSAF(N−1)<1.0 holds, assumes "1". If FSLB=0 holds, the program is immediately terminated, whereas if FSLB=1 holds, the lean feedback control flag FSLBFB is set to "1" at a step S85, whereby the lean-burn correction coefficient KLSAF(N) is set to the desired equivalent ratio KOBJ without subtracting the leaning correction term DAFL therefrom, followed by terminating the program terminated.

If DMSSLB≧MSLEAN1 holds at the step S74, it is determined at a step S78 whether or not the rotational speed variation amount DMSSLB is smaller than a second upper threshold value MSLEAN2 (see FIG. 9B). If DMSSLB<MSLEAN2 holds, it is further determined at a step S79 whether or not the rotational speed variation amount DMSSLB is smaller than the first upper threshold value (α×DMSBAVE). If DMSSLB<(α×DMSBAVE) holds, it is further determined at a step S80 whether or not the rotational speed variation amount DMSSLB is smaller than the first lower threshold value (β×DMSBAVE).

If DMSSLB<(β×DMSBAVE) holds at the step S80, the leaning correction term DAFL is set to a third predetermined value DAFL3 (<DAFL1) at a step S81, followed by the program proceeding to the step S82.

If DMSSLB≧(β×DMSBAVE) holds at the step S80, the lean-burn correction term KLSAF is held at the immediately preceding value at a step S86, followed by terminating the program.

If DMSSLB≧MSLEAN2 holds at the step S78, it is further determined at a step S87 whether or not the rotational speed variation amount DMSLLB is smaller than the first upper threshold value (α×DMSBAVE). If DMSSLB≧(α×DMSBAVE) holds, the enriching correction term DAFR is set to a first predetermined value DAFR1, whereas if DMSSLB<(α×DMSBAVE) holds, the enriching correction term DAFR is set to a second predetermined value DAFR2 which is smaller than the first predetermined value DAFR1 at a step S89, followed by the program proceeding to the step S91.

If DMSSLB≧(α×DMSBAVE) holds at the step S79, the enriching correction term DAFR is set to a third predetermined value DAFR3 (<DAFR1) at a step S88, followed by the program proceeding to the step S91.

Thus, when the rotational speed variation amount DMSSLB is large, the enriching correction term DAFR is set to a larger value as the rotational speed variation amount DMSSLB is larger, thereby preventing the combustion state of the engine from becoming still worse.

Referring again to FIG. 6, if FSLBFB=0 holds at the step S51, it is determined at a step S57 whether or not the immediately preceding value KLSAF(N−1) of the lean-burn correction coefficient is larger than a predetermined value KLSAFX1. If KLSAF(N−1)>KLSAFX1 holds, the leaning correction term DAFL is set to a fourth predetermined value DAFLX1 at a step S58, followed by the program returning to the step S82.

If KLSAF(N−1)≦KLSAFX1 holds at the step S57, it is determined at a step S59 whether or not a high load flag FSLBPZN, which, when set to "1", indicates that the engine is in a predetermined high-load operating condition, assumes "1". If FSLBPZN=0 holds, it is determined at a step S62 whether or not the immediately preceding value KLSAF (N−1) is larger than a predetermined value KLSAFX2 (<KLSAFX1). If FSLBPZN=1 holds at the step S59, or if KLSAF(N−1)≦KLSAFX2 holds at the step S62, the program proceeds to a step S60, wherein the average value DMSBAVE of the rotational speed variation amount DMSSLB is initialized, and at the same time, the lean feedback control flag FSLFB is set to "1" at a step S61, followed by the program proceeding to the step S71. The initialization of the average value DMSBAVE is carried out by setting the same to the present value DMSSLB(N) of the rotational speed variation amount.

If KLSAF(N−1)>KLSAFX2 holds at the step S62, it is determined at a step S63 whether or not the rotational speed variation amount DMSSLB is larger than the second upper threshold value MSLEAN2. If DMSSLB≦MSLEAN2 holds, the leaning correction term DAFL is set to a fifth predetermined value DAFLX2 at a step S67, followed by the program proceeding to the step S82.

If DMSLLB>MSLEAN2 holds at the step S63, which means that the combustion state of the engine has become worse or unstable, initialization of the average value DMSBAVE is executed and at the same time the lean feedback control flag FSLBFB is set to "1" at steps S64 and S65, respectively, similarly to the steps S60 and S61. Further, the enriching correction term DAFR is set to a fourth predetermined value DAFRX at a step S66, followed by the program proceeding to the step S91.

Figure 8A:
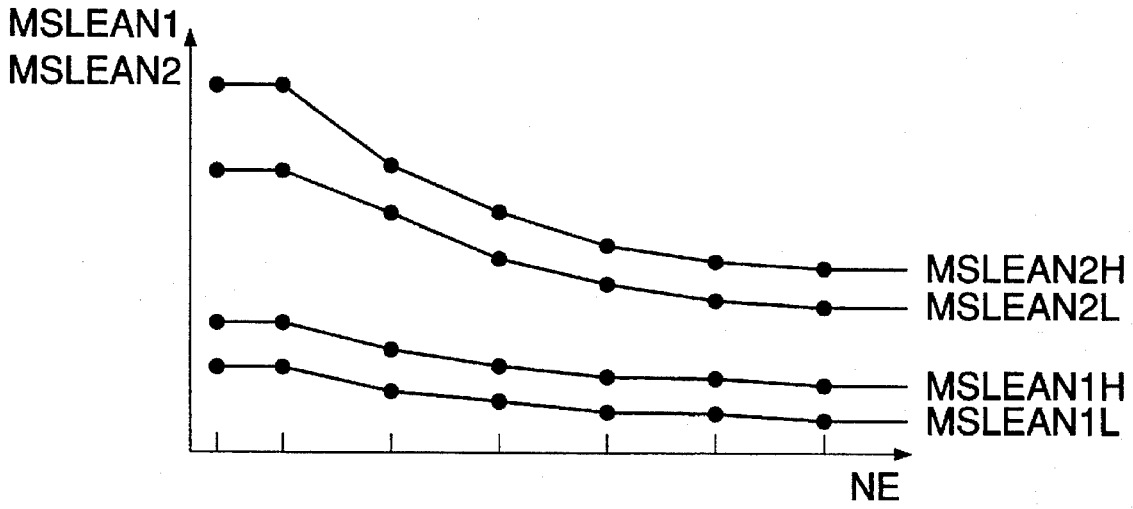
Figure 8B:
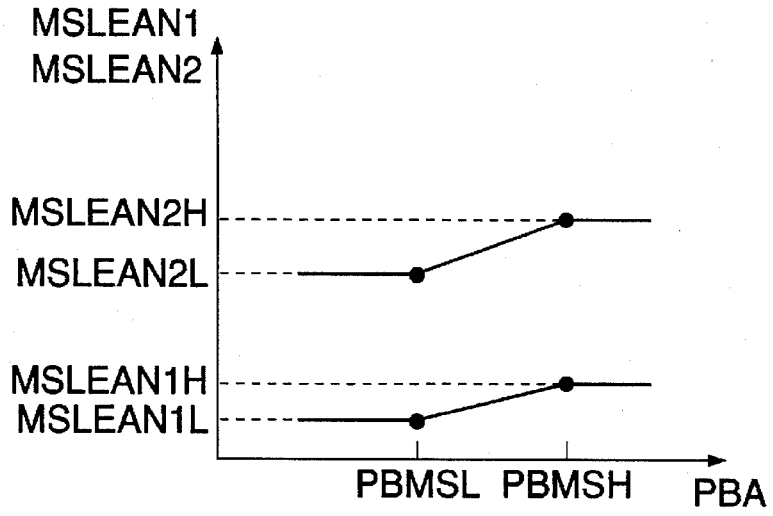

The second lower threshold value MSLEAN1 and the second upper threshold value MSLEAN2 employed in the FIGS. 6 and 7 processing are set in the following manner by executing a routine, not shown:

First, a table shown in FIG. 8A is retrieved according to the engine rotational speed NE to determine the upper threshold values MSLEAN1H, MSLEAN2H and lower threshold values MSLEAN1L, MSLEAN2L of the threshold values MSLEAN1, MSLEAN2. Then, as shown in FIG. 8B, if the intake pipe absolute pressure PBA is equal to or higher than an upper limit value PBMSH, the upper limit values MSLEAN1H and MSLEAN2H are employed as the threshold values MSLEAN1 and MSLEAN2, respectively, whereas if the intake pipe absolute pressure PBA is lower than a lower limit value PBMSL, the lower limit values MSLEAN1L, MSLEAN2L are employed as the same. If PBMSL<PBA<PBMSH holds, the MSLEAN1 value and the MSLEAN2 value are determined by interpolation.

Further, as shown in Table 1 below, depending on whether the vehicle on which the engine is installed is an MT (manual transmission) type or an AT (automatic transmission) type, as well as on the gear ratio of the transmission, correction coefficients KMSGRiM (I=3, 4, 5) and KMSGRjA (j=2, 3, 4) are determined, and the values determined based on the FIG. 8A and 8B tables are multiplied by these correction coefficients to determine final values of the threshold values MSLEAN1 and MSLEAN2.

TABLE 1

| | 3rd speed (AT: 2nd speed) | 4th speed (AT: 3rd speed) | 5th speed (AT: 4th speed) |
|---|---|---|---|
| MT | KMSGR3M | KMSGR4M | KMSGR5M |
| AT (CVT) | KMSGR2A | KMSGR3A | KMSGR4A |

These correction coefficient values are set such that KMSGR3M<KMSGR4M<KMSGR5M, and KMSGR2A<KMSGR3A <KMSGR4A. "CVT" in Table 1 represents a variable speed transmission, and when the gear ratio of the variable speed transmission assumes values corresponding to those of the second speed, the third speed, and the fourth speed of the AT, the values KMSGR2A, KMSGR3A, and KMSGR4A are selected, respectively.

The following is a summary of the first to third predetermined values DAFR1 to 3and DAFL1 to 3 of the correction terms DAFR and DAFL for the lean-burn correction coefficient KLSAF selected according to the rotational speed variation amount DMSSLB by executing the routine shown in FIGS. 6 and 7:

1) If DMSSLB≧MSLEAN2 and DMSSLB≧α×DMSBAVE, then DAFR=DAFR1;

2) If α×DMSBAVE>DMSSLB≧MSLEAN2, then DAFR=DAFR2 (<DAFR1);

3) If MSLEAN2>DMSSLB≧α×DMSBAVE, then DAFR=DAFR3 (<DAFR1);

4) If DMSSLB<MSLEAN2 and DMSSLB<α×DMSBAVE and DMSSLB≧MSLEAN1 and DMSSLB≧β×DMSBAVE, then KLSAF(N)=KLSAF(N−1), i.e. the lean-burn correction coefficient is held at he immediately preceding value;

5) If β×DMSBAVE>DMSSLB≧MSLEAN1, then DAFL=DAFL3 (<DFL1);

6) If MSLEAN1>DMSSLB≧β×DMSBAVE, then DAFL=DAFL2 (<DFL1); and

7) If DMSSLB<MSLEAN1 and DMSSLB<β×DMSBAVE, then DAFL=DAFL1.

That is, when the DMSSLB value is equal to or larger than the upper threshold value MSLEAN2 or α×DMSBAVE, the enriching correction term DAFR is set to a larger value as the DMSSLB value increases, whereas when the DMSSLB value is smaller than the lower threshold value MSLEAN1 or β×DMSBAVE, the leaning correction term DAFL is set to a larger value as the DMSSLB value decreases. When the DMSSLB value falls between the upper threshold value and the lower threshold value, the lean-burn correction coefficient KLSAF is held at the immediately preceding value.

Figure 9A:
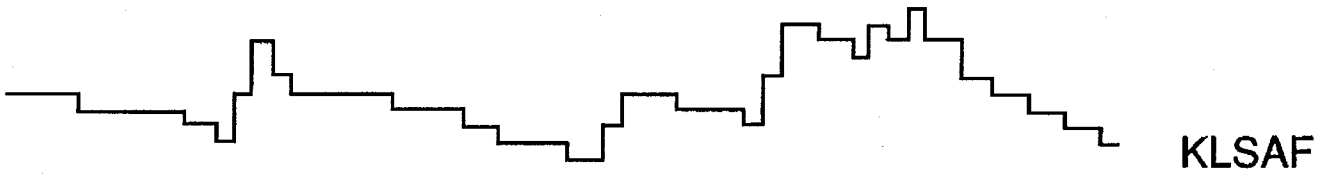
Figure 9B:
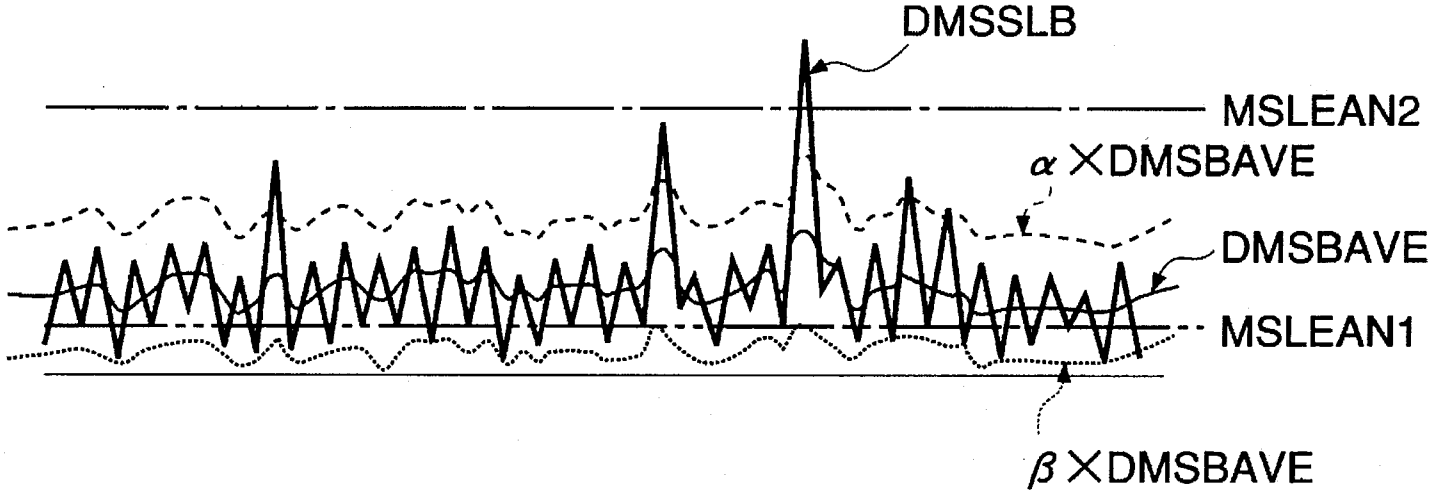

As described heretofore, according to the present embodiment, as shown in FIGS. 9A and 9B, the enriching correction term DAFR and leaning correction term DAFL for the lean-burn correction coefficient KLSAF are determined according to the engine rotational speed variation amount DMSSLB. As a result, it is possible to maintain good fuel economy without degrading the driveability of the engine. Moreover, according to the present embodiment, the rotational speed variation amount DMSSLB is compared with the first threshold values (α×DMSBAVE) and (β×DMSBAVE) which are calculated based on the average value DMSBAVE of the rotational speed variation amount DMSSLB, and depending on results of the comparison, the lean-burn correction coefficient KLSAF is set. As a result, it is possible to achieve the optimum lean-burn feedback control, which permits the optimum fuel economy to be attained without degrading the driveability of manufacturing variations of component parts of the engine between production lots and/or the degree of deterioration or aging of component parts of the engine.

Still further, according to the present embodiment, the second threshold values MSLEAN1, MSLEAN2 are also used for determining the correction terms DAFR, DAFL of the lean-burn correction coefficient KLSAF, which enables achievement of more accurate and fine lean burn feedback control. Further, the second threshold values MSLEAN1, MSLEAN2 are determined based on the engine rotational speed NE, the intake pipe absolute pressure PBA, and the gear ratio of transmission, it is possible to carry out the optimum lean-burn feedback Control in a manner suitable for different types of vehicles and operating conditions of the vehicle as well as those of the engine.

Although in the above described embodiment, the invention is applied to the lean-burn feedback control, this is not limitative, but the invention may be applied to exhaust gas recirculation control, providing similar results.

What is claimed is:

1. A control system for an internal combustion engine, comprising:

fuel supply amount-calculating means for calculating an amount of fuel to be supplied to said engine;

rotational speed variation-detecting means for detecting an amount of variation in rotational speed of said engine;

averaging means for averaging said amount of variation in said rotational speed of said engine detected by said rotational speed variation-detecting means;

rotational speed variation reference value-calculating means for calculating a rotational speed variation reference value based on an average value of said amount of variation from said averaging means;

comparison means for comparing said detected amount of variation in said rotational speed of said engine with said rotational speed variation reference value; and correction means for correcting said amount of fuel to be supplied to said engine, calculated by said fuel supply amount-calculating means, based on results of said comparison by said comparison means.

2. A control system according to claim 1, wherein said rotational speed variation reference value is set to such a value that when said detected amount of variation in said rotational speed of said engine exceeds said rotational speed variation reference value, a combustion state of said engine can become unstable.

3. A control system according to claim 2, wherein said correction means corrects said amount of fuel to be supplied to said engine in such a direction that said combustion state of said engine becomes stabilized, when said detected amount of variation in said rotational speed of said engine exceeds said rotational speed variation reference value.

4. A control system according to claim 1, wherein said rotational speed variation reference value comprises a first rotational speed variation reference value and a second rotational speed variation reference value, said first rotational speed variation reference value being set to such a value that when said detected amount of variation in said rotational speed of said engine exceeds said first rotational speed variation reference value, a combustion state of said engine can become unstable, said second rotational speed variation reference value being set to a value smaller than said first rotational speed variation reference value.

5. A control system according to claim 4, wherein said correction means corrects said amount of fuel to be supplied to said engine in such a direction that said combustion state of said engine becomes stabilized, when said detected amount of variation in said rotational speed of said engine exceeds said first rotational speed variation reference value, while said correction means corrects said amount of fuel to be supplied to said engine in such a direction that said engine has improved fuel economy, when said detected amount of variation in said rotational speed of said engine is below said second rotational speed variation reference value.

6. A control system for an internal combustion engine installed on an automotive vehicle, comprising:

operating condition-detecting means for detecting operating conditions of at least one of said engine and said automotive vehicle;

fuel supply amount-calculating means for calculating an amount of fuel to be supplied to said engine;

combustion state-detecting means for detecting a parameter indicative of a combustion state of said engine;

first combustion state reference value-calculating means for calculating a first combustion state reference value based on said parameter indicative of said combustion state of said engine detected by said combustion state-detecting means;

second combustion state reference value-calculating means for calculating a second combustion state reference value depending on said operating conditions of said at least one of said engine and said automotive vehicle detected by said operating condition-detecting means;

comparison means for comparing said detected parameter indicative of said combustion state of said engine with said first combustion state reference value and said second combustion state reference value; and correction means for correcting said amount of fuel to be supplied to said engine calculated by said fuel supply amount-calculating means, based on results of said comparison by said comparison means.

7. A control system according to claim 6, wherein said operating conditions of said at least one of said engine and said automotive vehicle include at least one of rotational speed of said engine, load on said engine, and a gear ratio of said automotive vehicle.

8. A control system according to claim 6, wherein said parameter indicative of said combustion state of said engine is an amount of variation in rotational speed of said engine.

9. A control system according to claim 6, wherein said first combustion state reference value is set based on an average value of said parameter indicative of said combustion state of said engine.

10. A control system according to claim 6, wherein said first combustion state reference value comprises a combustion-unstable side reference value set to such a value that when a degree of unstability of said combustion state of said engine indicated by said detected parameter exceeds said combustion-unstable side reference value, said combustion state of said engine can become unstable, and a combustion-stable side reference value set to a value higher in stability than said combustion-unstable side reference value.

11. A control system according to claim 10, wherein said correction means corrects said amount of fuel to be supplied to said engine in such a direction that said combustion state of said engine becomes stabilized, when said degree of unstability of said combustion state of said engine indicated by said detected parameter exceeds said combustion-unstable side reference value of said first combustion state reference value, while said correction means corrects said amount of fuel to be supplied to said engine in such a direction that said engine has improved fuel economy, when said degree of unstability of said combustion state of said engine indicated by said detected parameter is below said combustion-stable side reference value of said first combustion state reference value.

12. A control system according to claim 10, wherein said second combustion state reference value comprises a combustion-unstable side reference value set to such a value that when a degree of unstability of said combustion state of said engine indicated by said detected parameter exceeds said combustion-unstable side reference value of said second combustion state reference value, said combustion state of said engine can become unstable, and a combustion-stable side reference value set to value higher in stability than said combustion-unstable side reference value of said second combustion state reference value.

13. A control system according to claim 11, wherein said second combustion state reference value comprises a combustion-unstable side reference value set to such a value that when a degree of unstability of said combustion state of said engine indicated by said detected parameter exceeds said combustion-unstable side reference value of said second combustion state reference value, said combustion state of said engine can become unstable, and a combustion-stable side reference value set to a value higher in stability than said combustion-unstable side reference value of said second combustion state reference value, and wherein when said degree of unstability of said combustion state of said engine indicated by said detected parameter exceeds said combustion-unstable side reference value of said second combustion state reference value, said correction means corrects said amount of fuel to be supplied to said engine by the use of a first correction amount in such a direction that said combustion state of said engine becomes stabilized when said degree of unstability of said combustion state of said engine indicated by said detected parameter exceeds said combustion-unstable side reference value of said first combustion state reference value, while said correction means corrects said amount of fuel to be supplied to said engine by the use of a second correction amount smaller than said first correction amount in such a direction that said combustion state of said engine becomes stabilized when said degree of unstability of said combustion state of said engine indicated by said detected parameter is below said combustion-unstable side reference value of said first combustion state reference value.

14. A control system according to claim 11, wherein said second combustion state reference value comprises a combustion-unstable side reference value set to such a value that when a degree of unstability of said combustion state of said engine indicated by said detected parameter exceeds said combustion-unstable side reference value of said second combustion state reference value, said combustion state of said engine can become unstable, and a combustion-stable side reference value set to a value higher in stability than said combustion-unstable side reference value of said second combustion state reference value, and wherein when said degree of unstability of said combustion state of said engine indicated by said detected parameter is below said combustion-stable side reference value of said second combustion state reference value, said correction means corrects said amount of fuel to be supplied to said engine by the use of a first correction amount in such a direction that said engine has improved fuel economy when said degree of unstability of said combustion state of said engine indicated by said detected parameter exceeds said combustion-stable side reference value of said first combustion state reference value, while said correction means corrects said amount of fuel to be supplied to said engine by the use of a second correction amount larger than said first correction amount in such a direction that said engine has improved fuel economy when said degree of unstability of said combustion state of said engine indicated by said detected parameter is below said combustion-stable side reference value of said first combustion state reference value.

* * * * *